US005335623A

United States Patent [19]

Mahler

[11] Patent Number: 5,335,623

[45] Date of Patent: Aug. 9, 1994

[54] INSTRUMENT AND METHOD FOR COMPARING NUMERIC INDICIA

[76] Inventor: Edward Mahler, 47 Echo La., Larchmont, N.Y. 10538

[21] Appl. No.: 932,082

[22] Filed: Aug. 19, 1992

[51] Int. Cl.[5] ..... G09F 9/40

[52] U.S. Cl. ..... 116/323; 116/321

[58] Field of Search ..... 235/70 R, 70 A, 70 B, 235/70 C; 116/321, 322, 323, 324, 225

[56] References Cited

U.S. PATENT DOCUMENTS 1,602,479 10/1926 Bulmer et al. ..... 235/70 A
2,746,346 5/1956 Gaire ..... 235/70 B
2,871,582 2/1959 Frank ..... 235/84
3,397,838 8/1968 Ostrander et al. ..... 235/70 R
4,678,893 7/1987 Ruble ..... 235/70 A X
4,749,846 6/1988 Deaver ..... 235/70 B

*Primary Examiner*—William A. Cuchlinski, Jr.
*Assistant Examiner*—W. Morris Worth
*Attorney, Agent, or Firm*—Hopgood, Calimafde, Kalil & Judlowe

[57] ABSTRACT

An instrument and method for comparing numeric indicia. The instrument is configured for receiving at least two moveable members and has first numeric indicia positioned for cooperation with corresponding second numeric indicia on each member. Upon selective manipulation of each member, the first and second indicia are aligned such that the indicia may be compared by a user.

6 Claims, 2 Drawing Sheets

INSTRUMENT AND METHOD FOR COMPARING NUMERIC INDICIA

DISCLOSURE OF THE INVENTION

The invention relates generally to indicator devices and, more specifically, to an instrument and method for comparing numeric indicia.

While shopping, consumers typically compare prices of different sized containers of goods in order to determine which is the best value, i.e., the lowest cost per unit of goods. Some consumers rely on mental arithmetic while others carry an electronic calculator or a pad of paper and a pencil or pen to work out the math.

Although the mental arithmetic method may be effective for some, it is subject to delay and inaccuracy. Though generally more accurate, the paper and pencil method has been found inconvenient and time-consuming as well as wasteful of paper and other materials. Electronic calculators, while fast and accurate, are often costly and cumbersome to carry and operate while shopping.

The present invention provides an improved instrument for comparing numeric indicia. The instrument is configured for slidably receiving at least two members moveable relative thereto and has first numeric indicia positioned for cooperation with corresponding second numeric indicia on each member. Upon selective manipulation of the members, the first and second indicia are aligned so as to permit comparison of the indicia. The member which extends furthest from the instrument upon alignment of the indicia designates a product of optimum monetary value.

The present invention is further directed to a method of using an instrument for comparing numeric indicia, which comprises the steps of determining the price and quantity of a first product; manipulating a first moveable member of the instrument such that price indicia on the first member is opposite its corresponding quantity indicia on the instrument; determining the price and quantity of a second product; manipulating a second moveable member of the instrument such that price indicia on the second member is opposite its corresponding quantity indicia on the instrument; and reading the instrument by observing which member protrudes furthest to the right.

Accordingly, it is an object of the present invention to provide a simple, durable, reliable and economical device that allows a user to accurately determine which of selected products are the better money values.

The present invention will now be further described by reference to the following drawings which are not to be deemed limitative in any manner thereof.

The same numerals are used throughout the various figures of the drawings to designate similar parts.

Still other objects and advantages of the present invention will become apparent from the following description of the preferred embodiments.

Figure 1:
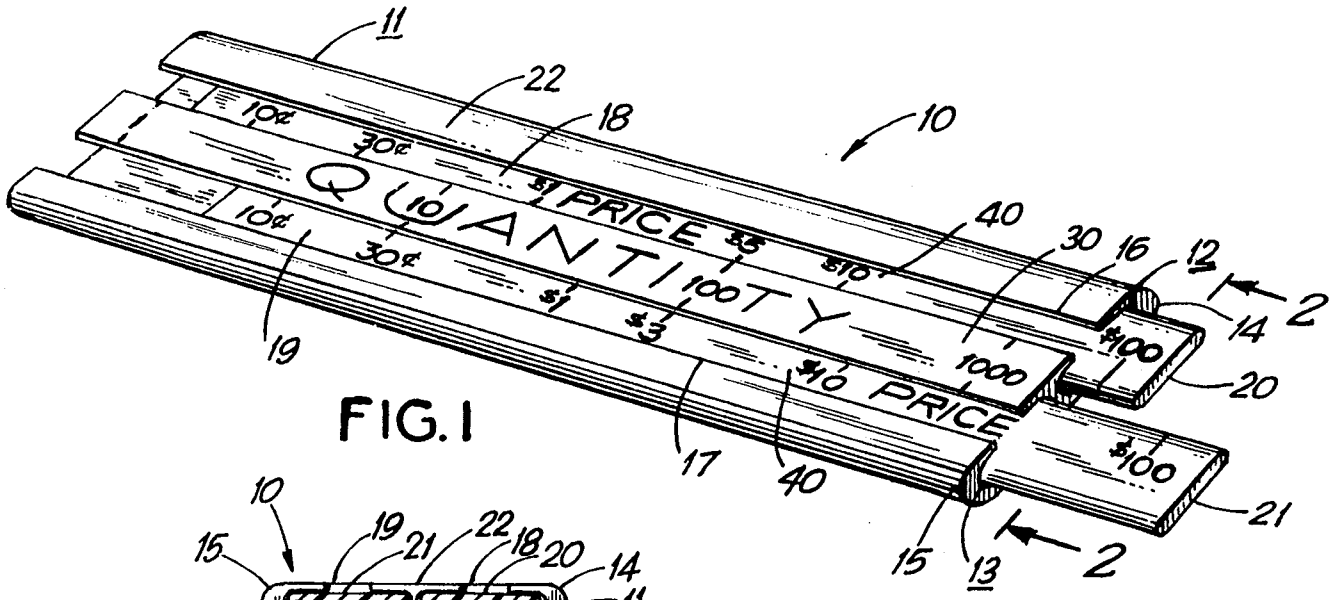
FIG. 1 is a perspective view of an instrument for comparing numeric indicia, in accordance with one aspect of the present invention.
Figure 2:
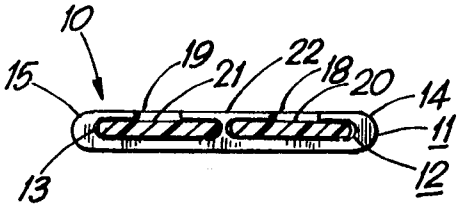
FIG. 2 is a sectional view of the instrument of FIG. 1 taken along line 2—2.

FIGS. 1 and 2 illustrate an instrument 10 for comparing numeric data in accordance with one aspect of the present invention. The instrument is configured for receiving at least two members 20, 21 moveable relative thereto and has first numeric indicia 30 positioned for cooperation with corresponding second numeric indicia 40 on each member. Upon selective manipulation of each member, the first and second indicia are aligned as desired, thereby permitting comparison of the indicia.

As shown in FIG. 1, the instrument has a relatively flat rectangular frame 11 with a pair of longitudinal tracks 12, 13 extending substantially the length thereof. The first track is located along upper portion 14 of the instrument and the second track is formed in instrument lower portion 15.

Each track is generally oblong in cross-section, as best seen in FIG. 2, for slidably receiving one of the similarly configured moveable members. The tracks are formed by recessed portions 16, 17 in the instrument, each portion having an opening 18, 19, respectively, which runs lengthwise along the instrument face 22. The opening extends parallel to the track and is relatively smaller in width than the recessed portion so as to retain the member inside the instrument. The openings provide windows for display of second numeric indicia on each member.

Each member 20, 21 is positioned in its corresponding track 12, 13, the members being configured so as to fit in the recessed portions at a relatively minimum clearance while being freely slidable into and out of the instrument. First numeric indicia 30, preferably calibrated to a logarithmic scale, are located, e.g., by printing, on the instrument face. Second numeric indicia 40 also to a logarithmic scale are, in turn, positioned along each member such that it is exposed by the openings upon engagement of the member with its respective track.

The first indicia are quantity data, e.g., in ounces, whereas the second indicia are price data, e.g., in dollars. It is understood, however, by those skilled in the art that the second numeric indicia on the members must be in the same units, e.g., dollars (price).

The first numeric indicia are a fixed center scale labeled "Quantity" on the instrument face and display three log cycles such as 1 to 10 to 100 to 1000. The second numeric indicia are on the two outer scales (located on the moveable member faces), each being labeled "Dollars" and having three log cycles such as 0.1 to 1 to 10 to 100.

In an alternative embodiment of the present invention, four or more log cycles are used in order to effect relatively extreme price-quantity product comparisons.

In use, the products to be compared by cost per unit of goods are first selected. This typically occurs when a shopper encounters a product packaged in two or more different quantities and prices. The price and quantity of the first product are then determined, e.g., by reading the manufacturer's label.

Next, first member 20 of the instrument (which corresponds to the first product) is moved by a user's finger along corresponding track 12 until second indicia 40 on the member, e.g., which correspond to the price of the product, are aligned with first indicia 30 on the instrument, e.g., which correspond to the quantity of the product.

Now, the price and quantity of a second product are determined. In a similar fashion, second member 21 (which corresponds to the second product) is moved by the user's finger along track 13 until second indicia 40 on the member, e.g., which correspond to the price of the second product, are aligned with first indicia on the instrument, e.g., corresponding to the quantity of the second product.

The instrument is then read by comparing the distance that each member's right hand end extends from the instrument's right end. The member which extends furthest from the instrument designates the corresponding product that is the best value among the products selected. The resulting distance between member ends indicates the extent of the savings.

To compare a third quantity (or size) of the same product, the member extending furthest to the right of the instrument is retained in its position. The remaining member is then repositioned by following the steps above. The member furthest to the right designates the best value of the three products. This step may be repeated to compare other sizes of the product.

While the present invention is shown and described as using a rectangular instrument displaying quantity data and a pair of slender rectangular movable members designating price data, it is understood that any size, shape or structural configuration could be utilized, giving consideration to the purpose for which the present invention is intended. For example, in an alternative embodiment of the present invention (see FIG. 4), three or more members (or scales), e.g., 20, 21 and 42, and a corresponding number of tracks are used to compare numeric indicia of three or more respective products.

Figure 3:
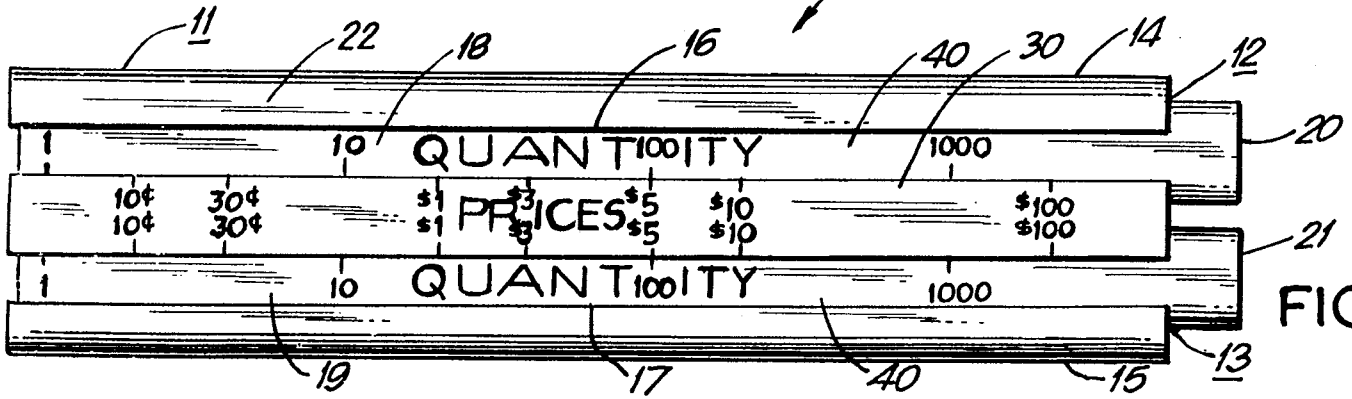
FIG. 3 is a plan view of an instrument for comparing numeric indicia, in accordance with another aspect of the present invention.

In another alternative embodiment, the numeric indicia are reversed, as shown in FIG. 3, such that the first indicia correspond to price data and the second indicia correspond with quantity data. In this embodiment, the slide protruding furthest to the left is the best value. Also, the quantity of either product that could be purchased for the same price is shown on the center scale.

In a further alternative embodiment, the instrument is constructed of a transparent material and has price-quantity indicia on one side and the reversed quantity-price indicia on the opposite side. Alternatively, price-quantity indicia of increased log scale are placed on the opposite side.

In another alternative embodiment, the instrument and corresponding members are of a circular configuration, the members having varying numbers of logarithmic cycles.

Figure 4:
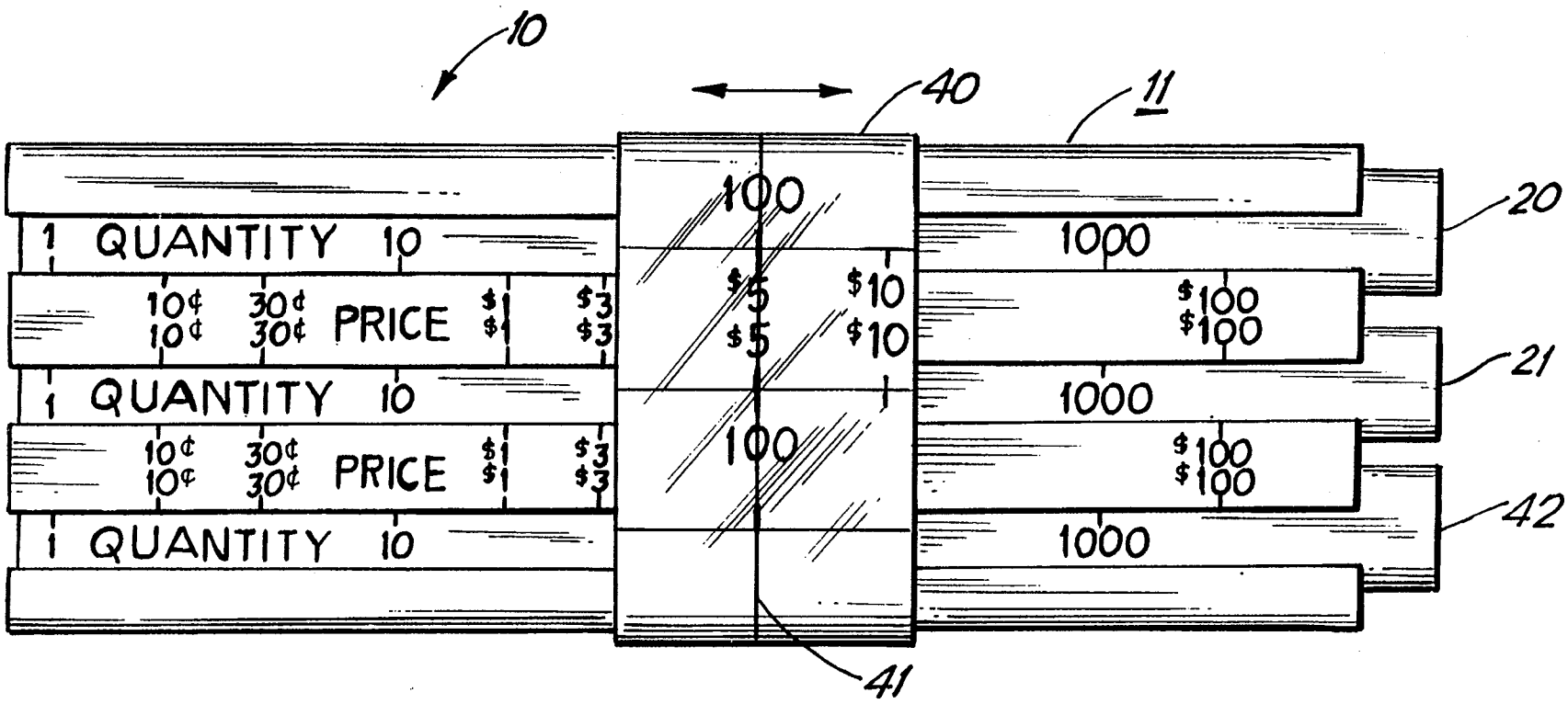
FIG. 4 is a plan view of an instrument for comparing numeric indicia, in accordance with still another aspect of the present invention.

Still another alternative embodiment, as also shown in FIG. 4, utilizes a relatively narrow rectangular sleeve 40 configured for sliding engagement with the instrument. Upon sliding the sleeve to a selected location along the instrument, a hairline 41 embedded in the sleeve assists the user in reading indicia aligned with the hairline. The face of the sleeve is preferably transparent and shaped so as to magnify the instrument face. A Fresnel lens shape, for example, has been found suitable. This magnification feature assists the visually impaired and aids the user in reading indicia of smaller versions of the present invention.

By moving the sleeve (and hairline) into alignment with a selected price on the center "Price" scale and adjacent quantities on each member's "Quantity" scale, the quantity at any price of either product is read. Moreover, to determine how much more (or less) of the product is obtained at one price than the other, the user reads the quantity on each member aligned by the hairline with the selected price and takes the difference. If, in the alternative, the "Price" and "Quantity" scales are reversed, the price difference (or savings achieved) may be determined.

It is preferred that the present invention be constructed of plastic or wood. However, it is understood by those skilled in the art that any material could be used, giving consideration to the intended purpose of the present invention.

Since from the foregoing the construction and advantages of the invention may be readily understood, further explanation is believed to be unnecessary. However, since numerous modifications will readily occur to those skilled in the art after consideration of the foregoing specification and accompanying drawings, it is not intended that the invention be limited to the exact construction shown and described, but all suitable modifications and equivalents may be resorted to which fall within the scope of the appended claims.

What is claimed is:

1. A method of using an instrument for comparing numeric indicia, which comprises the steps of:

(a) determining the price and quantity of a first product;

(b) manipulating a first moveable member slidably received in a frame of the instrument such that price indicia of a sequential array on the first member is generally aligned with its corresponding quantity indicia of a sequential array on the frame of the instrument;

(c) determining the price and quantity of the second product;

(d) manipulating a second moveable member slidably received in the frame of the instrument such that price indicia of a sequential array on the second member is generally aligned with its corresponding quantity indicia of the sequential array on the frame; and (e) reading the instrument by observing which member extends furthest to the right relative to the frame as a designation of the product having the lowest cost per unit.

2. The method set forth in claim 1 wherein price indicia on the first and second members are in like units.

3. An instrument for comparing numeric indicia, which comprises:

a frame;

at least two coextensive members movable relative to the frame, each member corresponding to a product to be compared;

the frame slidably receiving the members and having a sequential array of first numeric indicia which correspond to prices of products positioned for cooperation with a corresponding sequential array of second numeric indicia on each member relating to the product, such that upon selective manipulation of each member so as to align the first and second indicia, the member extending furthest to the left relative to the frame designates the product having the lowest cost per unit of second numeric indicia.

4. The instrument set forth in claim 3 wherein the first indicia are a logarithmic scale.

5. The instrument set forth in claim 3 wherein the second indicia are a logarithmic scale.

6. An instrument for comparing numeric indicia, which comprises:

a frame;

at least two coextensive members movable relative to the frame, each member corresponding to a product to be compared;

the frame slidably receiving the members and having a sequential array of first numeric indicia which corresponds to quantities of products positioned for cooperation with a corresponding sequential array of second numeric indicia on each member relating to the product, such that upon selective manipulation of each member so as to align the first and second indicia, the member extending furthest to the right relative to the frame designates the product having the greatest quantity per unit of second numeric indicia.

* * * * *